US005360673A

United States Patent [19]

Mayer et al.

[11] Patent Number: 5,360,673

[45] Date of Patent: Nov. 1, 1994

[54] SEMIFINISHED PRODUCT FOR ELECTRIC CONTACTS MADE OF A COMPOSITE MATERIAL BASED ON SILVER-TIN OXIDE AND POWDERMETALLURGICAL PROCESS OF MAKING SAID PRODUCT

[75] Inventors: Ursula Mayer; Roland Michal; Karl E. Saeger, all of Pforzheim, Germany

[73] Assignee: Doduco GmbH + Co. Dr. Eugen Durrwachter, Pforzheim, Germany

[21] Appl. No.: 549,015

[22] PCT Filed: Mar. 22, 1989

[86] PCT No.: PCT/EP89/00316

§ 371 Date: Sep. 17, 1990

§ 102(e) Date: Sep. 17, 1990

[87] PCT Pub. No.: WO89/09478

PCT Pub. Date: Oct. 5, 1989

[30] Foreign Application Priority Data

Mar. 26, 1988 [DE] Germany ..... 3810311

[51] Int. Cl.[5] ..... B22F 3/16

[52] U.S. Cl. ..... 428/546; 75/246; 75/247; 419/19; 419/38; 419/41; 419/42; 419/43; 428/547; 428/548; 428/567; 428/568

[58] Field of Search ..... 428/546, 547, 548, 567, 428/568, 569; 75/245, 246, 247, 343; 419/19, 38, 41, 42, 43

[56] References Cited

U.S. PATENT DOCUMENTS

| | | | |
|---|---|---|---|
| 2,486,341 | 10/1949 | Stumbock | 75/22 |
| 3,148,981 | 9/1964 | Ryshkewitch | 75/206 |
| 3,489,531 | 1/1970 | Schreiner et al. | 29/182.2 |
| 3,827,883 | 8/1974 | Neely | 75/153 |
| 3,954,459 | 5/1976 | Schreiner et al. | 75/206 |
| 4,023,961 | 5/1977 | Douglas et al. | 75/5 AC |
| 4,204,863 | 5/1980 | Schreiner | 75/234 |
| 4,426,356 | 1/1984 | Nair | 419/21 |
| 4,479,892 | 10/1984 | Shibata | 252/514 |
| 4,551,301 | 11/1985 | Schreiner | 419/21 |
| 4,609,525 | 9/1986 | Schreiner et al. | 419/6 |
| 4,622,269 | 11/1986 | Leung et al. | 428/550 |
| 4,680,162 | 7/1987 | Shibata | 419/21 |
| 4,764,227 | 8/1988 | Rothkegel et al. | 148/431 |
| 4,855,104 | 8/1989 | Rothkegel et al. | 419/28 |
| 4,954,170 | 9/1990 | Fey et al. | 75/229 |

FOREIGN PATENT DOCUMENTS

| | | |
|---|---|---|
| 182386 | 5/1986 | European Pat. Off. . |
| 219924 | 4/1987 | European Pat. Off. . |
| 2439053 | 5/1980 | France . |
| 2952128 | 6/1981 | Germany . |
| 3212005 | 10/1983 | Germany . |

*Primary Examiner*—Donald P. Walsh
*Assistant Examiner*—Chrisman D. Carroll
*Attorney, Agent, or Firm*—Dvorak and Traub

[57] ABSTRACT

A semifinished product for electric contact made from a composite material based on silver-tin oxide is described as well as a powder-metallurgical process of making said product. The structure of the semifinished products contains regions which contain no metal oxide or very little metal oxide in alternation with regions which contain the entire metal oxide component or a greatly predominating/share thereof in a fine division.

30 Claims, 1 Drawing Sheet

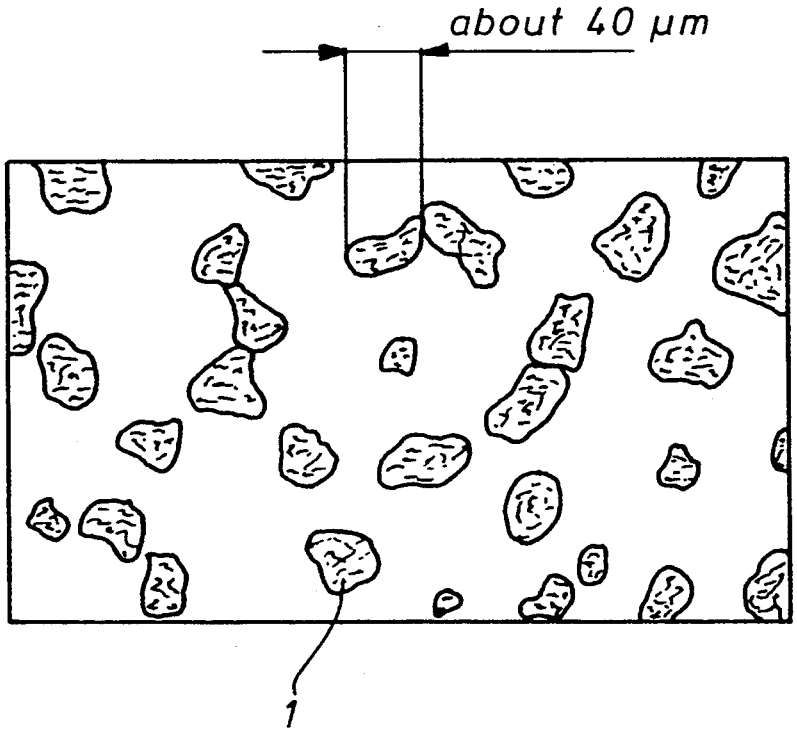
about 40 μm
1

SEMIFINISHED PRODUCT FOR ELECTRIC CONTACTS MADE OF A COMPOSITE MATERIAL BASED ON SILVER-TIN OXIDE AND POWDERMETALLURGICAL PROCESS OF MAKING SAID PRODUCT

TECHNICAL FIELD

This invention relates to a semifinished product for electric contacts made of a composite material based on silver-tin oxide and to a powder-metallurgical process of making said product.

STATE OF THE ART

This invention is based on a process having the features set forth in the prior art part of claim 1 and on a semifinished product having the features set forth in the prior art part of claim 14.

At the present time, contact materials based on silver-tin oxide have the best prospects of superseding the contact materials based on silver-cadmium oxide which have proved satisfactory but have fallen into disrepute owing to the toxicity of cadmium. The high importance gained by contact elements made of silver-cadmium oxide in low-voltage switchgear, particularly in motor contactors, is due to the fact that they optimally combine a long life, low tendency to weld, consistently low contact resistance (resulting in a low contact temperature rise), effective arc quenching and good workability. Presently known contact elements based on silver-tin oxide are closest to the contact elements made of silver-cadmium oxide as regards the combination of their properties but do not simultaneously attain such favorable properties in all respects stated hereinbefore.

It is known (DE-26 59 012 B2) that an extremely fine distribution of the metal oxides in the silver matrix will result in favorable properties of the contact. For this reason silver-cadmium oxide materials are often made by an internal oxidation of a silver-cadmium alloy. But it is generally not possible to make a semifinished product of silver-tin oxide by an internal oxidation of a corresponding workpiece made of a silver-tin alloy because a complete oxidation of the tin present in the interior of the workpiece will be obstructed by the formation of passive layers so that the oxidation is virtually restricted to a surface layer. The formation of a passivating layer can substantially be suppressed by an addition of other oxidizable metals, particularly indium or bismuth (DE-A 29 08 923). Contact elements made of such materials may be superior to elements made of silver-cadmium oxide as regards the life under AC3 and AC4 testing conditions (defined in IEC Standard 158-1). But the former exhibit in switchgear a higher contact temperature rise, by which the life of the switchgear may adversely be affected. Moreover, the internally oxidized contact elements cannot subsequently be deformed.

It is also known to make contact materials of silver-tin oxide by powder metallurgy in that a silver powder is mixed with a tin oxide powder, silver-tin oxide blanks are formed in that the powder mixture is compacted and sintered, and the blanks are shaped by extruding or extruding and rolling. In comparison with a silver-cadmium oxide contact material such a material which has been made by powder metallurgy and additionally contains tungsten oxide or molybdenum oxide in/small amounts may exhibit approximately the same good properties as regards contact temperature rise and superior properties in the AC4 life test but will be inferior in the AC3 life test. But it is difficult to deform the blanks by rolling or extruding because the tin oxide particles in the silver-tin oxide composite material will greatly obstruct its plastic deformation. A further difficulty is due to the fact that the working of the silver-tin oxide becomes increasingly difficult as the tin oxide is more finely dispersed in the material because in that case the tin oxide particles will more effectively obstruct the plastic deformation of the composite material as it is worked. In order to improve the workability it has been proposed in DE-A 29 52 128 to anneal the tin oxide powder at 900° to 1600° C. before it is mixed with the silver powder and thus to coarsen the tin oxide powder particles so that they will less strongly obstruct the subsequent working of the composite material. But the improved workability will involve a partial deterioration of the switching properties of the contact element because the tin oxide is no longer as finely divided in the composite material as before.

Semifinished products for electric contacts, which products consist of a composite material made by powder metallurgy and based on silver-tin oxide with an addition of at least one further metal oxide (molybdenum oxide, tungsten oxide, bismuth titanate) and of a carbide component (tungsten carbide and/or molybdenum carbide) are known from DE-32 32 627 C2.

It is known from EP 0 170 812 A2 that silver, tin, bismuth and copper can be melted to produce an Ag Sn BiCu alloy, the molten material can be sprayed under pressure to form an alloy powder and that powder can internally be oxidized and can then be compacted and sintered to produce contact elements. In comparison with contact elements made of silver-cadmium oxide the resulting contact elements exhibit approximately the same temperature rise and have no longer life in the AC3 test but a shorter life in the AC4 test.

From DE-29 29 630 A1 it is known to make a silver-tin oxide composite powder by a pyrolytic process and to make contact elements from that composite powder by compacting and sintering. In comparison with contact elements made of silver-cadmium oxide the resulting contact elements exhibit a longer life but also a higher contact temperature rise and a poorer workability. Similar remarks are applicable to the contact element which is known from DE 32 12 005 A1 and has been made by powder metallurgy from a silver-tin oxide composite powder and has an oxide-free back made of copper or a copper alloy. From the same DE-29 29 630 A1 it is also known to additionally include tungsten oxide or molybdenum oxide. Whereas the contact temperature rise can thus be decreased, the life in the AC3 test is shortened at the same time, German Patent Publication 26 59 012 discloses the making of a contact material consisting of silver and two different included metal oxides by a powder-metallurgical process in which two silver-metal oxide composite powders are mixed, compacted and sintered. One of said composite powder contains only one of the metal oxides and the other composite powder contains only the other metal oxide.

SUMMARY OF THE INVENTION

It is an object of the invention to provide for electric contacts a semifinished product which is based on silver-tin oxide and which in spite of a content of very small tin oxide particles can well be worked by extruding and rolling and at the same time is just as good as or superior to semifinished products based on silver-cadmium oxide as regards life, tendency to weld and contact temperature rise.

That object is accomplished by a process having the features set forth in claim 1 and by a semifinished product having the features set forth in claim 14. Desirable further features of the invention are covered by the dependent claims.

The semifinished product made in accordance with the invention consists of a composite material which is distinguished by having a special coarse structure in combination with a special fine structure. The coarse structure is present because the composite material contains high-oxide regions, in which all metal oxide or a greatly predominating share of the metal oxide component is concentrated, in alternation with low-oxide regions, which contain only a small share of the metal oxide component or are even free of oxide. The low-oxide regions may possibly have a low metal oxide content in a state of fine division in a matrix that is constituted by the material of the first component. The high-oxide regions contain the lion's share of the metal oxide component (in a concentration which is much higher than the conventional average metal oxide concentration in a contact material based on silver-tin oxide) and the balance of the material of the first component in a fine dispersion of one in the other as in a penetration- or inclusion-type composite material. Said regions have been formed from low-oxide and high-oxide powders, which have been mixed and compacted and optionally sintered. For this reason the size of the low-oxide and high-oxide regions by which the coarse structure of the composite material is constituted will depend on the size of the powder particles, The fine structure of the composite material is due to a distribution finely dispersed oxides in the high-oxide regions of the composite material which constitute the coarse structure and possibly also in the low-oxide region if they contain metal oxides. The entire metal oxide component is preferably contained in the composite powder which is employed so that the other powder which contains a major part of the silver or of the alloy consisting mainly of silver (first component) is entirely free of oxide. In that case the composite material will contain regions in which the metal oxide component is concentrated in alternation with regions which are entirely free of the metal oxide component. This will afford the advantage that the regions which contain the metal oxide component and particularly the tin oxide are substantially separated from each other by an oxide free matrix (they virtually "float" in an oxide-free matrix) so that they will much less strongly obstruct the plastic deformation during the rolling or extruding of the semifinished product than in a material in which the metal oxides are, more or less uniformly distributed throughout. In contrast, the semifinished product in accordance with the invention distinguishes by an improved deformability, which does not involve a higher tendency to weld or a shorter life or a higher electric contact resistance.

It is believed that that surprisingly favorable behavior of the contact material manufactured in accordance with the invention is due to the fact that the contact material does not differ from known contact materials based on silver-tin oxide by having a different total oxide content but differs from them in that said total oxide content has been distributed in the material in a novel manner so that regions having a high metal oxide concentration in the material of the first component alternate with regions having a low or infinitesimal metal oxide concentration in the material of the first component and, owing to the production by powder metallurgy, the size of said regions will depend on the size of the powder particles from which the composite material is made. In accordance with the invention those regions of the composite material in which the metal oxide component is present should contain said metal oxide component in a very fine division. The total content of the metal oxide component in the semifinished product may and should lie in the usual range between 5 and 25% by weight.

It is preferred to concentrate the entire metal oxide component in one of the composite powders so that the semifinished product contains regions which are entirely free of metal oxides and, as a result, the semifinished product has a particularly good deformability. But a small share of the metal oxide content may be included in the second powder, which contains a major share of the silver or silver alloy. That second powder may consist of a composite powder or of a powder mixture and should not contain the tin oxide and or any further oxides employed in a total in excess of 3% by weight (of the weight of that second powder). That share might be added individually or as a composite powder.

It has surprisingly been found that in comparison with conventionally made contact elements having the same composition the contact elements made from the semifinished product in accordance with the invention have a lower electric contact resistance so that they exhibit a lower contact temperature rise; this is another important advantage afforded by the invention. It is believed that this is related to the fact that in contact elements in accordance with the invention the tin oxide is less enriched at the contact-making surface. The fact that the content of finely dispersed tin oxide is high only in certain regions will promote the switching behavior and for instance, has the result that the tendency to weld is low.

It has also been found that contacts made from the semifinished product in accordance with the invention suffer a lower consumption than conventionally made contact elements having the same composition. The life determined by the AC3 and AC4 tests is longer than that of comparable AgCdO contacts.

That is a further advantage afforded by the invention.

In order to provide the structure in accordance with the invention comprising the low-oxide and high-oxide regions, a major part of the metal oxide component must be concentrated and included in the composite powder. Only the relatively small share of the metal oxide which may optionally be contained in the low-oxide regions of the composite material may be mixed, e.g., in the form of a pure oxide powder, with the powder consisting of the first component of the material. It is preferred to provide in the low oxide regions the same oxides as in the high-oxide regions. Any metal carbides (particularly tungsten carbide and/or molybdenum carbide) which are optionally also contained in the second component and the metals (particularly tungsten and/or molybdenum) which are not dissolved in the first component may be added as separate powders to the powder mixture and during switching operations may promote the wetting of the tin oxide with silver so that the contact resistance will be reduced.

The composite powder may be produced in that a molten alloy is sprayed which contains metals of the first component, tin and optionally further oxidizable or non-oxidizable metals of the second component, and the oxidizable metals are subsequently oxidized by the process of internal oxidation. It will be particularly desirable to make the composite powder in that an aqueous solution of salts of the metals of the first component and of tin is sprayed in a hot oxidizing atmosphere so that the salts are pyrolytically decomposed. That process is sometimes called spray pyrolysis and has been described in U.S. Pat. No. 3,510,291, EP-0 012 202 A1 and De-29 29 630 C2. Metals intended for the composite powder are dissolved in a liquid and the solution is atomized in a hot reactor or into a flame so that the solvent is suddenly evaporated. The resulting solid particles react with the oxygen in the oxidizing atmosphere in the flame or in the reactor at a temperature below the melting temperature of the dissolved metals and in the resulting powder particles the metals of the first component, i.e., the silver or the silver alloy, and the metal oxide component consisting substantially of the tin oxide, are present in a very fine division and bonded to each other. In the composite powder produced by pyrolysis most metal oxide particles have particle sizes between 0.1 μm and 1 μm (diameter); this is desirable For the process in accordance with the invention. The presence of such fine metal oxide particles will promote the development of the desired properties of the contact elements (low consumption, low tendency to weld, consistently low contact resistance), particularly if said oxide component is present in a composite together with a material (first component) which has a high electrical conductivity, as is the case in accordance with the invention.

The use of composite powders made by spray pyrolysis will afford the further advantage that the spray pyrolysis will particularly result in powder particles which are spherical or potato-shaped so that they will promote the formation of a deformable semifinished product because a plastic deformation of the contact material will be less strongly opposed by the spherical or potato-shaped particles than by irregularly jagged powder particles.

Any oxide and carbide components which may be present in addition to the tin oxide result in part in a decrease of the temperature at the points of contact during switching operations and in part in an increase of the/life of the contact elements not only at low and medium currents but even under heavy loads. Molybdenum carbide and tungsten carbide are effective even in small amounts. The content of additional carbides and oxides in the contact material should not be in excess of 6% by weight so that the contact material will not be too hard.

An addition of nickel to the composite material may also be desirable. Nickel is not soluble in the silver and may be mixed as a very fine powder to the powder that consists of silver or a silver alloy or nickel may be introduced as a silver-nickel powder made by spray pyrolysis.

DESCRIPTION OF THE DRAWING

The accompanying FIGURE is a schematic representation of the structure of a composite material which has been made in accordance with the second Example and which in a silver matrix formed by the oxide-free silver powder particles includes silver-tin oxide regions 1, most of which are smaller than 50 μm.

DETAILED DESCRIPTION OF THE INVENTION

1st EXAMPLE

To make a composite powder which contains 10% by weight tin oxide and 0.3% by weight bismuth oxide, a melt consisting of a corresponding silver-tin-bismuth alloy is sprayed. The resulting silver-tin-bismuth alloy powder having a particle size below 100 μm is internally oxidized at a temperature of 700° C. in an oxidizing atmosphere for 6 hours. Thereafter, 75 parts by weight of a commercial silver powder having a particle size of less than 40 μm and 25 parts by weight of the silver-tin-oxide-bismuth oxide composite powder are dry-mixed for 1 hour and are subsequently isostatically compacted to form blocks weighing about 50 kg, and subsequently sintered at a temperature of 830° C. for 1.5 hours. The resulting block is placed into the chamber of an extruder and in conjunction with a reduction of its cross-section is hot-extruded at a temperature of about 850° C. to form a billet having a cross-section of 10×75 $mm_2$ and is subsequently clad by hot rolling with a fine silver plate having s thickness of 1.5 mm, and is then hot-rolled to a final thickness of 2 mm and processed further in conventional processes to form contact platelets.

2nd EXAMPLE

To make a silver-tin oxide composite powder which contains 32% by weight tin oxide, an aqueous solution of silver nitrate and stannous chloride is sprayed into an oxygen-containing atmosphere in a reactor which has been heated to 950° C. The particles of the resulting silver-tin oxide composite powder contain the tin oxide in a very fine division. 75 parts by weight of silver powder having a particle size of less than 40 μm and 25 parts by weight of the silver-tin oxide composite powder are subsequently dry-mixed for one hour and are processed further as in the first Example to form contact platelets, in which the silver-tin oxide composite material contains 8% by weight tin oxide.

3rd EXAMPLE

The second Example is modified in that 0.5% by weight tungsten carbide (particle size of less than 10 μm) and 0.3% by weight tungsten carbide (particle size of less than 2.5 μm) are added to the powder mixture. In other respects the processing is the same as in the second Example. The addition of tungsten oxide and tungsten carbide results in a decrease of the temperature at the point of contact and in an increase of the life of electric contact elements made from the semifinished product.

4th EXAMPLE

To make a silver-tin oxide-tungsten oxide composite powder which contains 20% by weight tin oxide and 0.5% by weight tungsten oxide, an aqueous solution of silver nitrate. stannous chloride and tungsten(II) chloride is sprayed into an oxygen-containing atmosphere in a reactor which has been heated to about 950° C. The powder particles of the resulting silver-tin oxide-tungsten oxide composite powder contain the tin oxide and the tungsten oxide in a very fine division. 50 parts by weight of a silver powder having a particle size of less than 40 μm and 50 parts by weight of the silver-tin oxide-tungsten oxide composite powder are dry-mixed for one hour and are then processed further as in the first Example to form contact platelets.

5th EXAMPLE

A silver-tin oxide composite powder which contains 30% by weight tin oxide is made as in the second Example. To make a silver-nickel composite powder which contains 2% by weight nickel, an aqueous solution of silver nitrate and nickel(II) chloride is sprayed into an inert gas atmosphere (e.g., argon) in a reactor which has been heated to about 950° C. The powder particles of the resulting silver-nickel composite powder contain the nickel in a very fine division.

50 parts by weight of the silver-tin oxide composite powder and 50 parts by weight of the silvernickel composite powder were then dry-mixed for one hour and were processed further as in the first Example to form contact platelets.

6th EXAMPLE

The fifth Example can be modified in that the silver-tin oxide composite powder is mixed with a silver powder and a carbonyl-nickel powder rather than with a silver-nickel composite powder. In other respects the processing is the same as in the fifth Example.

Industrial Utility

Semifinished products made in accordance with the invention are particularly suitable for contact elements in low-voltage switchgear, such as motor contactors.

We claim:

1. A powder-metallurgical process of making a semifinished product based on silver in combination with tin oxide for electric contacts comprising a composite material having 60 to 95% by weight of a first component with a high electric conductivity, namely, of silver or a silver based alloy, and a second component, which is insoluble in the first component and reduces the tendency of the contacts to weld and their consumption and which based on the weight of the composite material has 3 to 25% by weight of tin oxide, 0 to 10% by weight of one or more further metal oxides excluding silver oxide which together with the tin oxide comprise the metal oxide component, 0 to 10% by weight of one or more metal carbides and 0 to 10% by weight of one or more additional metals, which are insoluble in the first component, wherein the tin oxide predominates in the second component and the average content of the metal oxide component in the composite material is not in excess of 25% by weight, in that a composite powder which contains less than one-half of the first component and 60 to 100% based on the metal oxide component of the metal oxide component is mixed with one or more powders which contain the balance of the first component and of the second component, and the powder mixture is compacted to form shaped bodies consisting of the composite material, in which low-oxide and high-oxide regions are present in a statistically uniform distribution and the high-oxide regions are formed by the composite powder particles.

2. A process according to claim 1, characterized in that the shaped bodies are subsequently sintered.

3. A process according to claim 1 characterized in that the shaped bodies are subsequently reshaped by embossing, extruding or by extruding and rolling.

4. A process according to claim 1, characterized in that the entire metal oxide component is incorporated in the composite powder.

5. A process according to claim 4, characterized in that the entire second component is incorporated in the composite powder.

6. A process according to claim 1, characterized in that the further metal oxides in powder form are mixed with the powder of the first component and the composite powder of the second component.

7. A process according to claim 1, characterized in that the further metals of the second component in powder form are mixed with the powder of the first component and the composite powder of the second component.

8. A process according to claim 1, characterized in that the alloy powder is made in that a molten material which contains the intended share of the first component, tin and optional further oxidizable and non-oxidizable metals of the second component is sprayed to produce an alloy powder and the oxidizable metals contained in said alloy powder are subsequently oxidized by a process of internal oxidation.

9. A process according to claim 1, characterized in that the composite powder is made in that a solution of salts of the metals of the first component and of a salt of a salt of tin is sprayed into a hot oxidizing atmosphere in which the salts are pyrolytically decomposed.

10. A process according to claim 9, characterized in that the solution contains also salts of the further oxidizable metals.

11. A process according to claim 10, characterized in that the solution contains salts of all oxidizable metals which are intended for the second component.

12. A process according to claim 1, characterized in that the share of the composite powder in the powder mixture is not in excess of 45% by volume.

13. A semifinished product based on silver in combination with tin oxide for electric contacts comprising a composite material having 60 to 95% by weight of a first component with a high electric conductivity, namely, of silver or a silver based alloy and of 40 to 5% by weight of a second component, which is distributed but insoluble in the first component and reduces the tendency to weld and the consumption and which based on the weight of the composite material has 3 to 25% by weight tin oxide, 0 to 10% by weight of one or more further metal oxides excluding silver oxide which together with the tin oxide comprise the metal oxide component, 0 to 10% by weight of one or more metal carbides and 0 to 10% by weight of one or more additional metals, which are insoluble in the first component, wherein the tin oxide predominates in the second component and the average content of the metal oxide component in the composite material is not in excess of 25% by weight, characterized in that the structure of the composite material comprises low-oxide regions, in which the content of the metal oxide component is 0 to 20% of its average content and is present in a fine division in a matrix formed by the material of the first component, in alternation with high-oxide regions, in which the content of the metal oxide component is 1.5 to 6 times its average content in the semifinished product and which contains also the balance of the first component in a fine distribution of one in the other, wherein the low-oxide and high-oxide regions are present in the composite material in a statistically uniform distribution and the low-oxide regions surround a large part of the high-oxide regions.

14. A semifinished product according to claim 13, characterized in that the low-oxide regions constitute at least 40% by volume of the composite material and the high-oxide regions constitute the balance.

15. A semifinished product according to claim 14, characterized in that the low-oxide regions constitute at least 55% by volume of the composite material.

16. A semifinished product according to claim 13, characterized in that the composition of the metal oxide component is the same in the low-oxide regions and in the high-oxide regions.

17. A semifinished product according to claim 13, characterized in that the entire metal oxide component is concentrated in the high-oxide regions.

18. Semifinished product according to claim 17, characterized in that the entire second component is concentrated in the high-oxide regions.

19. A semifinished product according to claim 13, characterized in that the high-oxide regions have volumes smaller than $500\times10^{-6}$ mm$^3$.

20. A semifinished product according to claim 19, characterized in that the high-oxide regions have volumes smaller than $35\times10^{-6}$ mm$^3$.

21. A semifinished product according to claim 13, characterized in that the first component comprises fine silver.

22. A semifinished product according to claim 13, characterized in that the first component is an alloy of silver with 0.1 to 10% by weight of copper.

23. A semifinished product according to claim 13, characterized in that the first component is an alloy of silver with 0.1 to 10% by weight of palladium.

24. A semifinished product according to claim 13, characterized in that the second component contains a refractory metal in an amount of 0.1 to 10% by weight of the mass of the entire composite material.

25. A semifinished product according to claim 24, characterized in that the refractory metal is tungsten or molybdenum.

26. A semifinished product according to claim 13, characterized in that the further metal oxides present in the second component are selected from the group that includes tungsten oxide, molybdenum oxide, bismuth oxide, bismuth titanate and copper oxide.

27. A semifinished product according to claim 13, characterized in that the metal carbide in the second component is selected from the group that includes tungsten carbide molybdenum carbide.

28. A semifinished product according to claim 13, characterized in that the composite material contains up to 10% by weight of nickel.

29. A semifinished product according to claim 28, characterized in that the composite material contains less than 1% by weight of nickel.

30. A process according to claim 2, characterized in that the shaped bodies are subsequently reshaped by embossing, extruding or by extruding and rolling.

* * * * *